US005370320A

United States Patent [19]

Sofer

[11] Patent Number: 5,370,320

[45] Date of Patent: Dec. 6, 1994

[54] FUEL INJECTOR FOR INTERNAL COMBUSTION ENGINES

[76] Inventor: Daniel Sofer, Avenida Julio de Mesquita 959 - apto 112, 13023 Campinas, Brazil

[21] Appl. No.: 94,068

[22] Filed: Jul. 28, 1993

[30] Foreign Application Priority Data

Feb. 5, 1991 [BR] Brazil ..... MU 7100246

[51] Int. Cl.[5] ..... B05B 1/30

[52] U.S. Cl. ..... 239/585.1; 239/900; 251/129.14; 251/129.21

[58] Field of Search ..... 239/585.1, 900; 251/129.14, 129.21

[56] References Cited

U.S. PATENT DOCUMENTS

| | | | |
|---|---|---|---|
| 3,865,312 | 2/1975 | Lombard et al. | 239/585.1 |
| 4,308,890 | 1/1982 | Saito | 137/495 |
| 4,846,439 | 7/1989 | Suzuki | 251/129.21 |

FOREIGN PATENT DOCUMENTS

| | | | |
|---|---|---|---|
| 0007724 | 2/1980 | European Pat. Off. | F02M 51/08 |
| 0063952 | 11/1982 | European Pat. Off. | F02M 51/08 |
| 0404667 | 12/1990 | European Pat. Off. | F02B 47/02 |
| 2221929 | 5/1972 | Germany | 251/129.14 |
| 2445493 | 4/1976 | Germany | 251/129.14 |
| 0018179 | 2/1981 | Japan | 239/900 |
| 0066575 | 6/1981 | Japan | 251/129.14 |
| 0136074 | 6/1986 | Japan | 251/129.14 |
| 2147690 | 5/1985 | United Kingdom | 239/900 |

*Primary Examiner*—Andres Kashnikow
*Assistant Examiner*—Christopher G. Trainor
*Attorney, Agent, or Firm*—Edward D. Manzo

[57] ABSTRACT

The fuel injector comprises a magnetic valve member with three dimensions of the same magnitude, a valve member seat on which the valve member is seatable, a magnetic core disposed opposite to the valve member seat and excitable by a solenoid to attract the valve member and generate a clearance between the seat and the valve member which allows the flow of fuel, and an injection section through which the fuel which has passed the clearance is injected out of the injector. The valve seat is shaped as a duct and the clearance between the valve member and the seat has a first portion of decreasing section and a second portion of increasing section.

13 Claims, 6 Drawing Sheets

FUEL INJECTOR FOR INTERNAL COMBUSTION ENGINES

Figure 1:
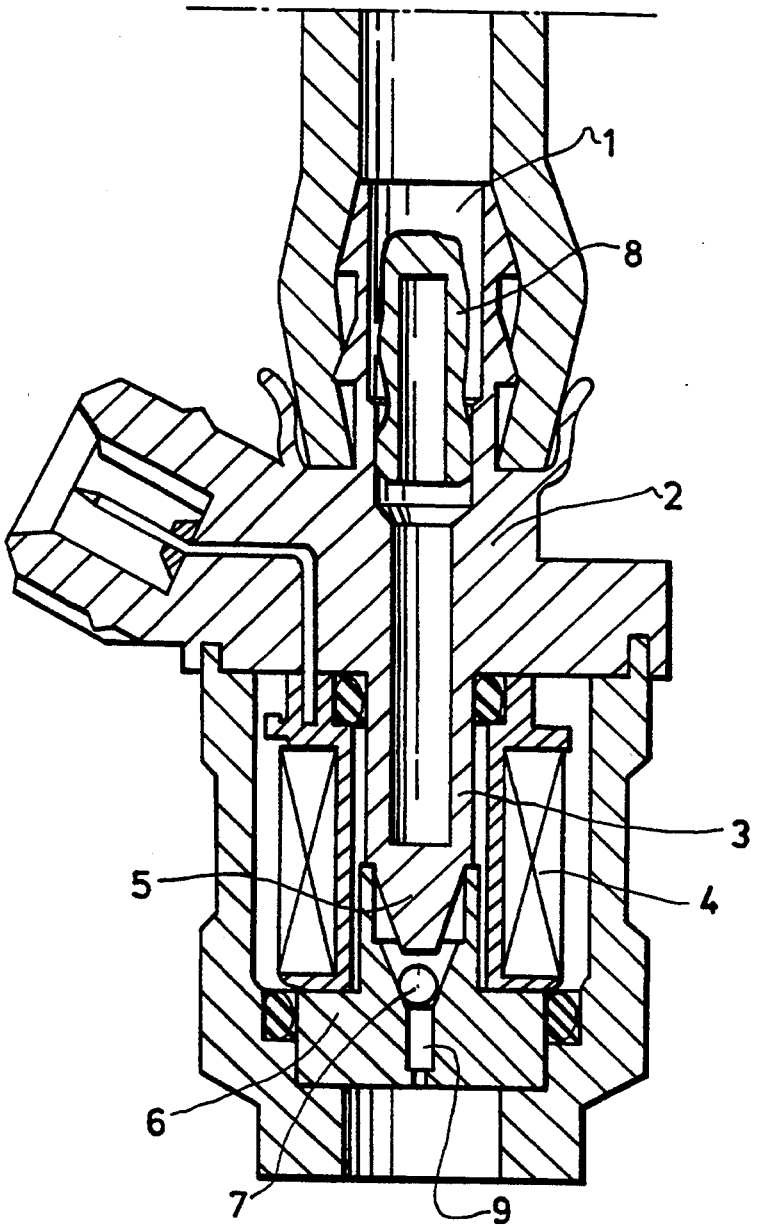
Figure 2:
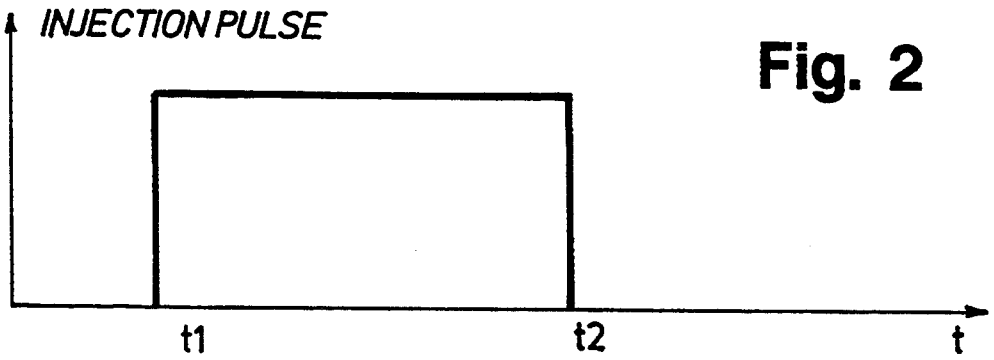
Figure 3:
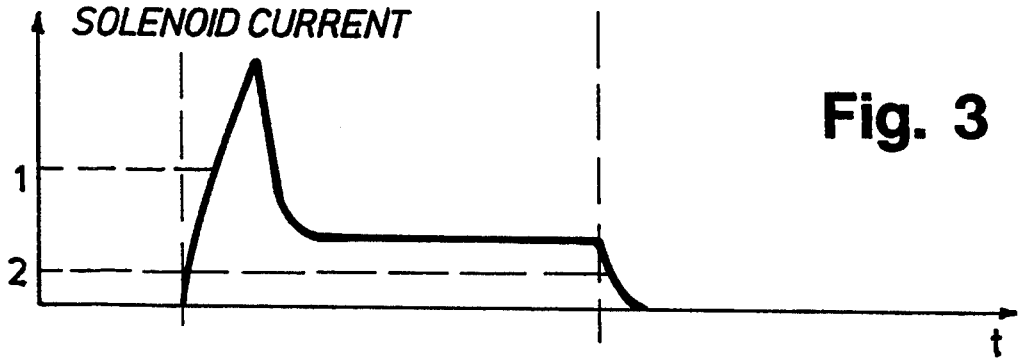
Figure 4:
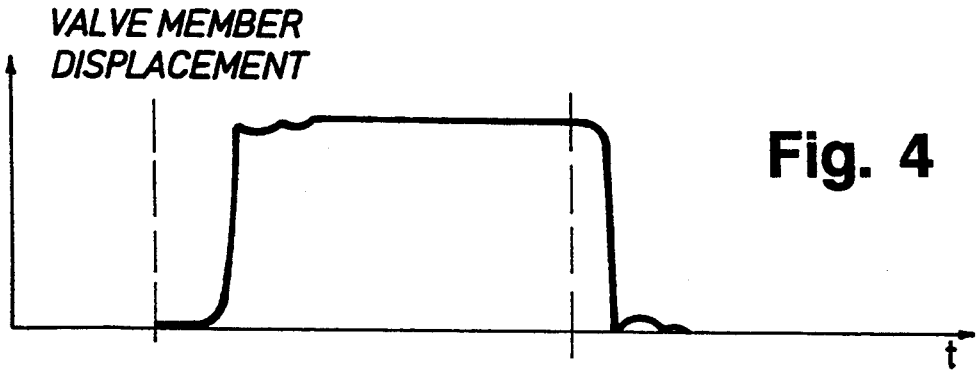

The present invention relates to an electromagnetic fuel injector for use in Otto cycle internal combustion engines in association with an electronic fuel injection system (EFI). EFI systems control the air/fuel ratio of the engine and, therefore, allow low emissions operation of said engine. However, in order to achieve precise control of the air/fuel ratio the entire system must operate within extremely strict tollerances, and, must also maintain such precision of operation for the longest time possible, in order to guarantee good long term stability.

The fuel injector is that component of a fuel injection system that is responsible for the actual delivery of the fuel to each cylinder. It is an electromagnetically operated valve which, macroscopically speaking, has two states: open or closed. When the injector is closed, no fuel can flow through it. When the electronic control unit sends an injection pulse to the fuel injector it will open thus allowing the fuel to pass through the injector's valve and out of the injector through the spraying orifice and finally to the intake airstream of the engine.

As this brief description shows, the control over the air/fuel ratio is achieved by the injection pulse width modulation. Roughly speaking, the injection pulse frequency is proportional to engine rpm, while its duty cycle is proportional to engine load.

Of course, any real world fuel injector cannot pass from the closed state to the open state instantly. A certain transient time will always be present. This transient time is due to all of the inertias of the injector (electrical, magnetic and mechanical inertias). The shortest the transient time of a fuel injector, the closer it will be to the ideal fuel injector and more precise can the control over the air/fuel ratio be.

More particularly, the present invention relates to a fuel injector according to the pre-characterising portion of claim 1.

A fuel injector of this kind is disclosed in EP-A-0 063 952.

A fuel injector according to EP-A-0 063 952 provides for closing the valve member with hydrodynamic forces generated by the pressure differential between the upper and lower surfaces of said valve member, which is placed within a cylindrical cavity in order to augment said pressure differential. The walls of said cavity serve also as part of the magnetic circuit, being the path through which the magnetic flux will return to the body.

However, in the injector disclosed in EP-A-0 063 952 the magnetic core extends beyond the axial length of the solenoid and therefore the magnetic flux dispersion is not negligible, particularly with low solenoid currents. In order to overcome this drawback, the present invention provides for a fuel injector according to the characterising portion of claim 1.

In the injector according to this invention, the valve seat is the only part of the fuel injector through which the magnetic flux returns to the body, not being necessary to use a side magnetic pole or a guide of any type to achieve the desired performance of the magnetic circuit. The valve member is totally unguided in its movements, and therefore no friction is generated during the movements.

The use of a magnetic valve seat enables a simplification in the valve assembly while maintaining excellent operation, even at extremely low currents.

This is made possible thanks to the fact that any movement of the valve member towards the core results in a decrease of magnetic reluctance, and, being the valve seat made of magnetic material, the magnetic flux is more than enough to create high forces, even at low currents.

Preferably, in the injector according to the present invention, the valve seat has a conical shape and the valve member is spherical. Moreover, the valve member itself has an extremely low mass and this enables extremely fast operation.

In addition to this, the fuel injector has good long term stability and fuel tightness. Should, however, fuel tightness be a problem, either a spring or an elastic member containing magnetic particles may be used in a further embodiment of the invention to create a complementary force on the valve member in order to prevent fuel leakage. Or, as another alternative, it is possible to use an unidirectional valve at the entrance of the fuel injector, opposite to the injection valve. Such unidirectional valve can be simply made with a sphere and a spring, therefore enabling extremely easy assembly while maintaining very good performance. Or, in those cases where particular requirements are made to the project, more elaborate assemblies can equally well be fitted to the present fuel injector. However, regardless of what is the detailed operation of the unidirectional valve, its task is that of maintaining the high pressure within the injector even when the fuel pump is not operating. Such high pressure is, by itself, enough to create a static biasing force capable of preventing any fuel leakage that could otherwise be present due to the gradual decrease in fuel line pressure when the fuel pump is not operating.

Finally, the fuel injector according to the present invention can be designed to match any requirements on fuel spray pattern, since the injection of the fuel can be accomplished by one or more orifices, being that each can have different shape, dimensions and orientation. Therefore, it is possible to tailor the spray pattern of the present fuel injector according to each specific application, enabling increased overall performance of the fuel injection system and the engine itself.

A further subject of the present invention is constituted by a 2 or 4 stroke internal combustion engine fitted with a fuel injection system using one or more fuel injectors as above described.

Figure 5:
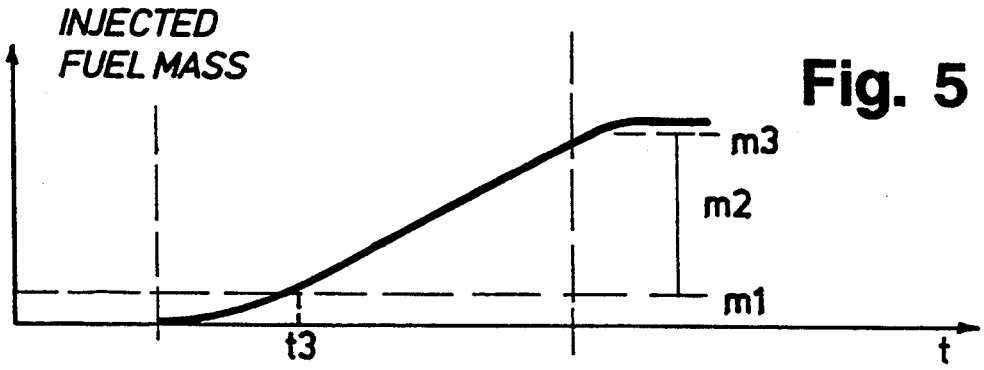
Figure 6:
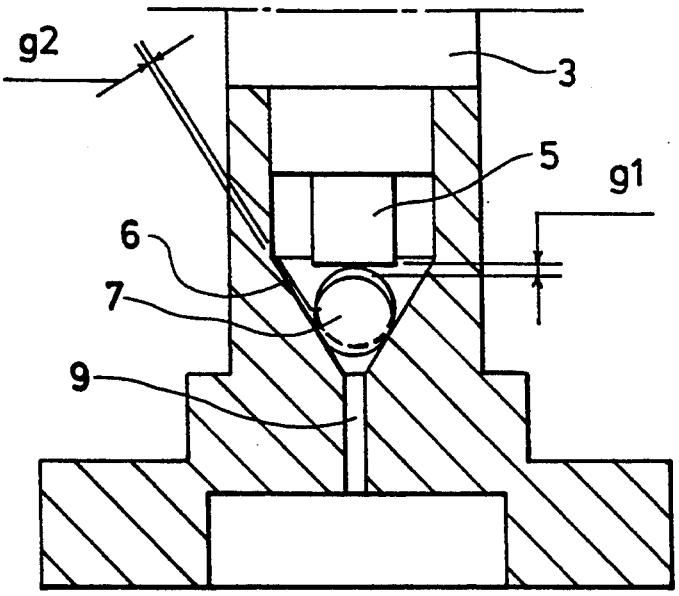
Figure 7:
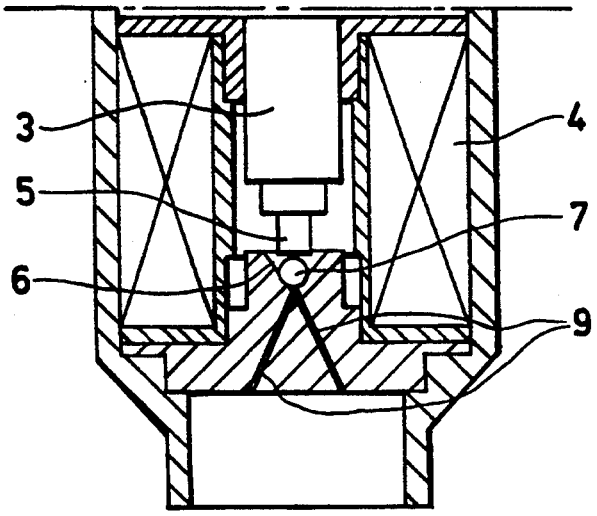
Figure 8:
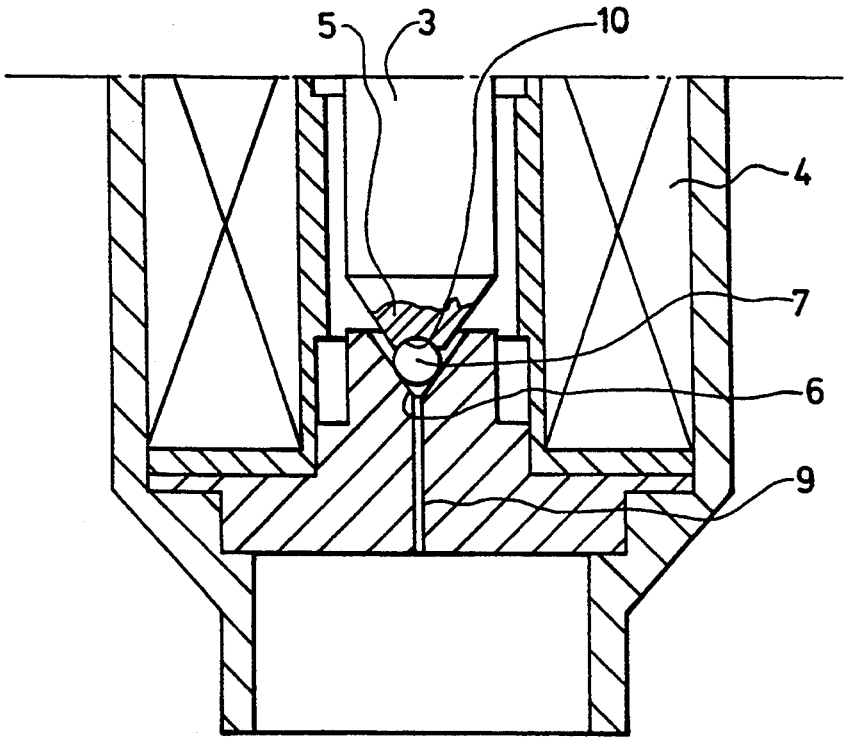
Figure 9:
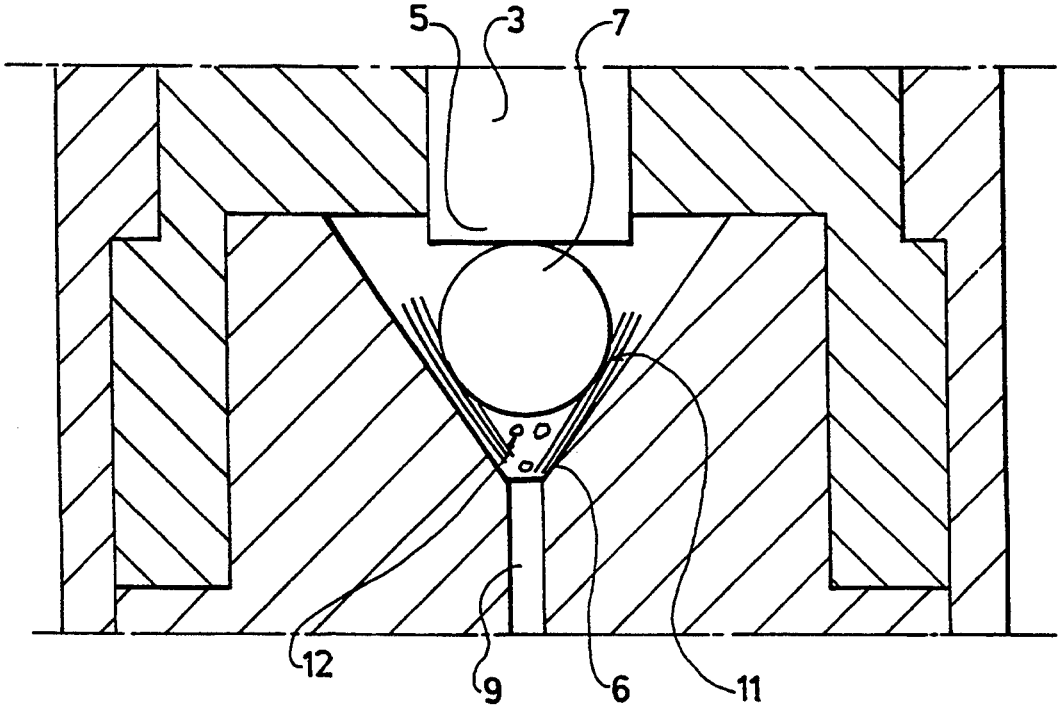
Figure 10A:
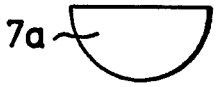
Figure 10B:
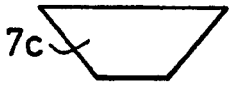
Figure 10C:
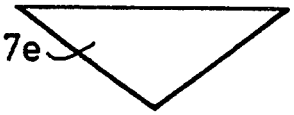
Figure 10D:
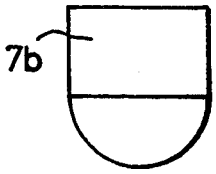
Figure 10E:
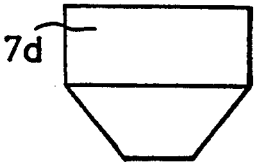
Figure 10F:
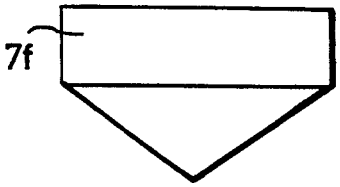
Figure 10G:
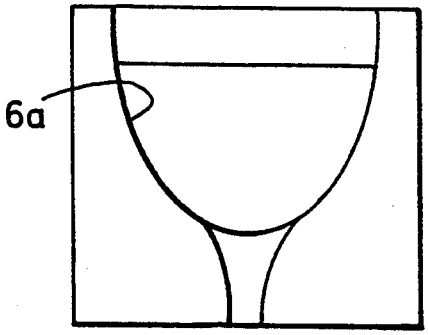
Figure 10H:
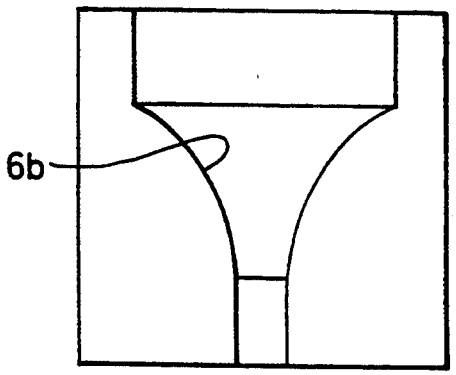
Figure 11:
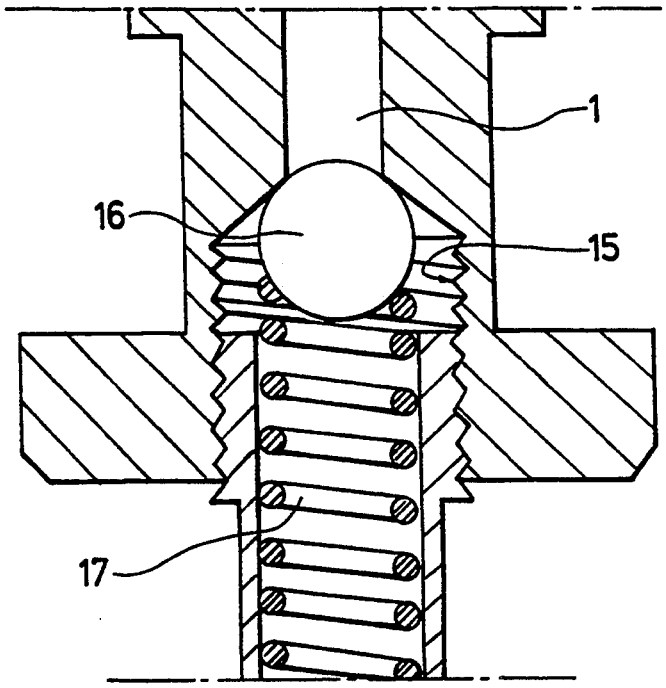
Figure 12:
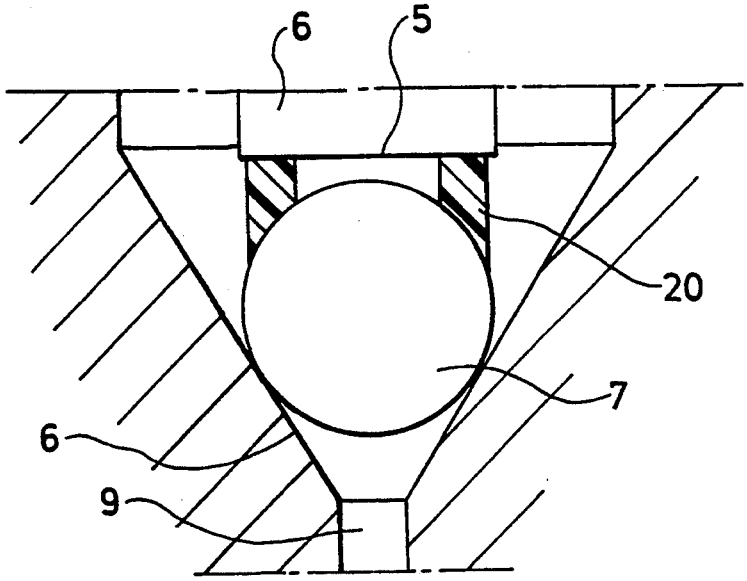

Further advantages and characteristics of the present invention will become apparent from the following detailed description and with reference to the accompanying drawings, given only by way of non-limiting example, wherein:

FIG. 1 is a cross section of a fuel injector according to the invention,

FIGS. 2–5 are schematic diagrams representing the value of some parameters of the injection versus time, FIG. 6 is a schematic view of a detail of the injector of the invention, FIGS. 7–8 illustrate further embodiments of the injector according to the invention, FIG. 9 schematizes the way of operation of the injectors of the preceding figures, FIGS. 10*a*–10*h* illustrate further possible embodiments of the valve member and the valve member seat of the injector according to the invention, and FIGS. 11–12 illustrate further embodiments of the injector according to the invention provided with additional features.

A fuel injector (FIG. 1) comprises a body 2 with a fuel inlet duct 1, wherein a fuel filter 8 is provided. A magnetic spherical valve member 7 is placed in a valve member seat 6 shaped as a conical duct, which terminates in an injection orifice 9 having two successive sections of different diameter. A magnetic core 3 excitable by a solenoid coil 4 is placed opposite to the seat 6 beyond the valve member 7 and has a flat extremity 5, which acts as a stopper for the valve member 7.

In order to understand the mechanisms acting within the fuel injector during its operation, FIGS. 2–5 show respectively schematic diagrams of the waveforms of the injection pulse (FIG. 2), the current pulse through the solenoid coil 4 (FIG. 3), the valve member 7 displacement (FIG. 4) and the injected amount of fuel (FIG. 5). The injection pulse is a binary signal (e.g., either "1" or "0") that lasts from instant t1 to instant t2. With no remarkable delay the current driver circuit will start the flow of an electric current through the solenoid coil 4. The current rise, although, is not instantaneous and has a finite speed, which depends, among other things, on the injector's inductance. The presence of the electric current creates a magnetic flux in and around the solenoid coil 4. In the attempt of reducing the amount of potential energy stored in the magnetic circuit, which is a natural tendency for all physical systems, the magnetic circuit (e.g. the paths along which the magnetic field flows) will tend to reduce its magnetic reluctance.

In order to reduce the global magnetic reluctance of the injector a force will start acting upon the valve member 7 so as to reduce the global air gap in the magnetic circuit. This force depends on the instant value of the electric current (or, to be more precise, the value of the magnetic field flux), so it will increase as the electric current rises to its peak value. When the electric current reaches the value I1, the magnetic force acting on the valve member 7 will equal the existing biasing force on said valve member 7. So being, any further increase in the electric current through the solenoid coil 4 will start the valve movement towards the core 3.

As the valve member 7 leaves its seat 6, the fuel will start flowing through the fuel injector. Of course, since the valve member 7 is not yet in its fully open position, the result is a fuel flow rate that is different from the static flow rate. This is translated into an injected fuel mass that is not a linear function of the elapsed time, as can be noticed from FIG. 5.

The fuel flow rate will continue to increase until the valve member 7 comes to rest on the stopper 5 in instant t3. The bouncing effects are largely exaggerated in FIG. 4, and, in the present invention they are, in most cases completely absent. With the valve member in its fully open position the fuel flow rate is exactly the static flow rate, and, therefore, the injected mass is a linear function of the elapsed time. The valve member 7 will stay in this position in order to allow the injection of the required amount of fuel.

When the valve member 7 is in this fully open position, the magnetic circuit reluctance is much lower than it was with the valve member 7 in a fully closed or partly open position. So being, in order to maintain a given magnetic field flux in said magnetic circuit, the electric current required through the solenoid coil 4 is also smaller, and can therefore be reduced. Moreover, taking into account the fact that the force to simply hold the injector open is much smaller than that required to start its opening movement, it is understandable that a substantial drop in solenoid current can be accepted. In addition to this, the fact of reducing energy dissipation (which would simply generate undesired heat) in the current driver circuit and the coil 4 itself is a good reason for actually reducing the electric current through the solenoid coil 4.

However, the main reason for this reduction in the current is that by cutting the current through the coil 4 will also cut the magnetic flux in the magnetic circuit and thus the magnetic force acting on the valve member 7. At the end of the logic injection pulse the current driver circuit will stop providing energy to the solenoid coil 4, and the electric current will begin to reduce its magnitude, with a speed that depends, among other things, on the inductance of the injector. As a result of the previous drop in coil current, this switch-off reduction can be more readily performed, and, when the current reaches the value I2, the magnetic force will no longer be greater than the biasing force. This difference between the sustaining force and the hydrodynamic biasing force will generate an acceleration on the valve member 7, which will therefore start its closing movement towards the valve seat 6. During this movement, once more, the injected fuel mass is not a linear function of the elapsed time, since the fuel flow rate is not the static flow rate anymore. The fuel flow rate will continuously decrease until the valve member 7 reaches the seat 6 and no more fuel can flow through the valve member 7.

As can be noticed, the total amount of fuel that is injected in each cycle performed by the fuel injector can be divided in three different parts. The first, ml, is the mass of fuel that is injected during the opening transient. The second, m2, is the mass of fuel that is injected during the lapse of time during which the valve member is in its fully open position. The third part of the injected fuel, m3, is that injected during the closing transient of the fuel injector. It is useful to notice that the first and the third part of the injected fuel mass, ml and m3 respectively, strongly depend on several design, project and operating variables, but (allowing an injection pulse width long enough to make sure that the valve member will reach it fully open position) they are not affected by the injection pulse width.

In other words, these are intrinsic characteristics of the fuel injector, its driving circuit and some operational conditions (such as battery voltage, fluid viscosity, etc.). It is noticeable that the limitations to any injector's performance at extremely short and long injection pulse widths are posed by these non-linear transient behaviours.

This means that if a fuel injector is to be designed in order to operate at extremely high frequencies, of 1000 Hz and above, as well as to maintain perfectly linear operation from extremely low (5%) up to extremely high (97%) duty cycles (resulting in an extremely wide dynamic control range), it is absolutely necessary to drastically reduce both opening and closing transient times of the injector. And such high frequencies of operation might be particularly useful in high speed engines such as 2 stroke engines.

This reduction was achieved in the present invention, but, contemporarily, no other crucial aspect of the operation of a fuel injector was disregarded (such as overall simplicity, fuel sealing, long term stability, durability, resistance to deposits build-up, low current operation, etc.).

As can be noticed again from FIG. 1, the design of the fuel injector was simplified to an extreme extent, the spherical unguided valve member 7 being the only moving part in the injector. The conical valve seat 6 can be either machined or simply press worked or even sintered, since the sphere cone sealing is well known for its self-centering mechanism and its good leakage resistance.

It is also noticeable that no biasing spring is present in this preferred embodiment. This further simplifies the fuel injector, the closing force being provided by accurately engineered hydrodynamic forces, whose generation will be exhaustively described in the following of the description.

Moreover, it must also be noticed that no side magnetic pole, no guide whatsoever and no separate member of the magnetic circuit is used to close the magnetic circuit around the spherical valve member 7. This is yet another simplification of the present fuel injector, that has, as its most appealing characteristic, a high quality performance at much lower production costs.

When an electric current flows through the solenoid coil 4, as it was explained above, the magnetic circuit will try to minimize its global reluctance. So, in order to create an opening force on the spherical valve member 7, it is necessary to assure that any valve member 7 displacement towards the core 3 is accompanied by a reduction in the global magnetic reluctance.

And, at the same time, the total air gap must be minimized, in order to achieve high magnetic flux and thus high acting forces. These tasks, in other known injectors have been accomplished by a side magnetic pole or by using a guide made of magnetic material for the valve member. Such side member or guide have not been used and are definitely not necessary in the present fuel injector, since a simpler cheaper and virtually equally effective way was found to ensure an adequate magnetic circuit.

In the present invention, the valve member seat 6 can be made of magnetic or non-magnetic material. When a low current operation of the fuel injector is desired, as in most actual cases, the valve member seat 6 has to be made of magnetic material.

In this case, the magnetic field flux will flow through the core, find the first air gap gl, (FIG. 6), then flow through the spherical valve member 7, through the magnetic valve seat 6 and the magnetic body of the fuel injector. The natural tendency to reduce the magnetic reluctance will create a magnetic force on the valve member 7, in order to reduce the working air gap. As it leaves the valve seat 6, the air gap between the core 3 and the valve member 7 decreases, while a new gap is created between the valve member 7 and the valve seat 6.

In the case of a conical valve seat 6 it can be easily noticed than any displacement of the valve member 7 will generate a new gap g2 that is smaller than the reduction in existing gap gl. Therefore it is understandable that using a magnetic valve seat 6 is an efficient way of generating the needed magnetic force without having to use any further magnetic element or guide.

In certain cases, where current limitation is extremely severe, it might be useful to modify valve seat 6 geometry in order to achieve even smaller final gaps, so as to obtain greater forces from the same electric current.

In those cases where extremely fast acting should be required, the valve seat 6 can be made of non magnetic (and even non metallic) material. This requires higher currents for a correct operation of the fuel injector (although general concepts remain exactly the same), but, due to lower global inductances, this leads to extremely fast operation.

Moreover, the injection takes place through one or more orifices 9, that entirely determine the spray pattern of the fuel injector. These orifices can be cylindrical or not, according to specific needs of each project, as well as they can be parallel to each other and/or the injector's axis or not. It is understandable that in some cases more than one injection orifice 9 will be used, for instance in multi-valve engines, where considerable improvements are to be achieved by aiming injected fuel spray directly onto the intake valves. One example of the use of more than one orifice is depicted in the embodiment of FIG. 7.

In the preferred embodiment of FIG. 7, the core 3 has a frusto conical extremity 5, with a flat end, on which the spherical valve member 7 rests when it is in the fully open position. The frusto conical shape of the extremity 5 of the core 3 works as to concentrate the magnetic field flux towards the spherical valve member 7, thus increasing the resulting magnetic force on the valve member 7, through the actual reduction of the flux leakage (e.g. by reducing the amount of magnetic flux that does not flow through the valve member 7 and therefore does not create any force on it). This guidance of the flux can also be performed, even if less successfully by a cylindrical extremity 5, like the one shown in the embodiment of the FIG. 7, which illustrates another possible core 3 for the present fuel injector.

The flat end for the magnetic core 3 is, obviously the simplest one that can be thought of, and therefore it is also the cheapest to obtain. However, as far as high performance is concerned, improvements are to be obtained by using a core 3 like the one shown in the embodiment of FIG. 8. This core 3 has a frusto conical cavity 10 that has basically two different functions. The first is that a cavity can accurately position the spherical valve member 7 when it is in the open position, thus eliminating any possible lateral oscillation of said valve member 7.

The second function of the cavity 10 is that of increasing the area through which the magnetic flux passes from the core 3 to the valve member 7. This increase produces a greater force acting on the spherical valve member 7, and therefore a faster acting of the injector.

As was mentioned above, one of the major peculiarities of the present fuel injector is its closing mechanism. It is responsible for the capability of this fuel injector to operate at speeds and frequencies that no other known fuel injector can tolerate, and, therefore, must be depicted in detail.

First of all it must be born in mind that if short transients are desired, high accelerations on the valve member 7 are needed. In order to obtain high accelerations two things are necessary: a high force acting on the valve member 7 and a small valve member 7 mass.

So being in the present fuel injector the valve member 7 has been engineered to have the smallest mass possible. For instance, in the preferred embodiments of FIG. 1, 7 and 8 the valve member 7 is a sphere, which can have diameters ranging from 0.3 mm to 2 mm (in high frequencies applications; higher diameters may be used in other cases). To these values of diameter correspond approximately valve member masses ranging from 0.1 mg to 30 mg.

As is noticeable, the moving mass is extremely small, and, therefore, the mechanical inertias are also drastically reduced.

However, if fast acting is required, a high biasing force is also required. In order to obtain the greatest simplification possible of the design and assembly of the fuel injector, such force could not be provided by a spring (at least in most cases, where the small dimensions of the valve member would render the use of a spring extremely difficult). So, hydrodynamic forces were boosted by appropriate design and engineering of the valve assembly, in order to assure the closing of the fuel injector.

First of all the valve member 7 is placed entirely (with reference to FIG. 9, which schematically represents the common structure of the injectors of FIGS. 1, 7 and 8), within a conical duct, which is also the valve seat 6. It is, however, useful to notice that if it was not for the need of placing the valve member 7 within this duct 6 the valve seat 6 would be considerably shorter. So, the shape of the duct/seat 6 is dictated by its requirements as a shaped duct. The matching between the shapes of the duct 6 and the valve member 7 is made so that an extreme acceleration is generated in the fluid flow, which at the narrowest point 11 of the clearance between the valve member 7 and the seat 6 has its maximum speed.

This acceleration is obtained by a reduction of the free area, through which the fuel can flow.

Just after such restricting portion of the clearance, which brings about an intense acceleration of the fuel, a portion of the clearance with increasing free flow area for the fuel is provided, so that the flow would tend to decelerate. But, due to its high speed, the flow is not capable of decelerating, and, therefore, does not follow the contours of the valve member 7 anymore. This detachment of the fluid flow from the valve member 7 generates, in the area underneath it, an extremely low pressure area 12. Since the corresponding area in the upper part of the valve member 7 is under high pressure, a force is generated on the valve member 7.

The magnitude of this force is determined by the initial fuel pressure and by the area on which the pressure differential will act. With the valve 7 used in the mentioned embodiments of the invention the area on which the pressure difference acts can be of up to 90% of the total area. Higher values may be obtained with particular duct designs for special cases. It can thus be noticed that an extremely effective way of controlling and tailoring the hydrodynamic force has been obtained, and that this way also allows extremely high forces (compared with other hydrodynamic closure valve assemblies) acting on the valve member 7.

It may be useful to notice that other shapes than sphere and cone can be successfully employed in this valve member and valve member seat assembly, each match obtaining peculiar achievements.

FIG. 10 illustrates some profiles of valve members of emispherical *7a*, *7b* frusto conical *7c*, *7d* and conical *7e*, *7f* shape, which can be matched with valve member seats of curvilinear shape, respectively convex *6a* or concave *6b*.

It must also be said that the high speed operation achieved by the injectors of the present invention does not deteriorate their performance in any other requirement made to fuel injectors, such as fuel tightness and long term durability.

As a matter of fact, due the extremely low mass of the valve member 7, all impacts are very low energy ones, therefore wear and geometrical deterioration, which are responsible for the decay of long term durability, are limited to an extreme extent, in comparison to existing injectors.

As for fuel tightness, the simple coupling of the valve member and the valve seat is, in most of the cases, more than sufficient to assure perfect tightness with a minor fuel pressure (which is generally present even with the pump turned off, during parking of the vehicle). However, should it be necessary to provide for extra tightness guarantees, several different devices may be used in an injector according to the invention.

The first device is an unidirectional valve 15 (FIG. 11) placed in the fuel inlet 1 of the fuel injector itself, opposite to the fuel valve assembly, along with the fuel filter. This valve 15 will be opened by the fuel flow, and thus will not interfere with the fuel injector's normal operation. Whenever the pump is turned off, this valve will switch to the closed position, therefore maintaining a high fuel pressure within the fuel injector itself. This high pressure is, thus, enough to assure fuel tightness without any further element. The unidirectional valve 15 is formed simply by a sphere 16 and a spring 17, as it is shown in FIG. 11. This unidirectional valve 15 is capable of high performances while maintaining extreme overall simplicity of the entire injector assembly. The sphere 16 can be made of any material, for example rubber, several types of plastic and an extremely wide variety of metals, from aluminum to steel.

In some cases, though, extreme project requirements may force the use of more elaborate unidirectional valve assemblies, that, in spite of different principles of operation, do not alter the concept above mentioned of maintaining a high pressure within the fuel injector itself.

The second device is (FIG. 12) an elastic element 20 placed between the extremity 5 of the magnetic core 3 and the valve member 7. The elastic element may be a common spring or an elastic member made of a specific resin in which iron, or other magnetic material, particles have been dispersed. This elastic member would act as a sort of spring, though not being one. It would create a force on the valve member 7 that would ensure fuel tightness. Yet, the fact of being made, partly, of magnetic material would bring about an increase in the magnetic flux and thus in the global magnetic force acting on the valve member. Therefore in this latter case not only fuel tightness but also faster acting of the injector is obtained.

I claim:

1. A fuel injector comprising a body, a guideless magnetic valve member having three dimensions of the same magnitude, a valve member seat, on which the valve member is seatable, a magnetic core disposed opposed to the valve member seat, a solenoid which is annularly shaped and defines a cavity wherein the core is positioned, the core being excitable by the solenoid in order to attract the valve member and generate a clearance between the seat and the valve member, which allows the flow of fuel, and a fuel injection section, through which the fuel which has passed said clearance is injected out of the injector, said valve seat extending in the direction of the core to constitute a duct and the clearance between the valve member and the seat having a first portion of decreasing section and a second portion of increasing section, characterized in that the valve member seat is made of magnetic material and is positioned at least partially within said cavity defined by the solenoid, whereby the valve member is always at least partially within said cavity, both when attracted or not attracted by the core.

2. A fuel injector as in claim 1, characterized in that the duct constituted by the valve member seat is fully positioned within the cavity defined by the solenoid.

3. A fuel injector as in claim 2, characterized in that the duct constituted by the valve member seat encloses the valve member.

4. A fuel injector as in claim 1, characterized in that the duct constituted by the valve member seat is conically shaped and the valve member is spherical.

5. An injector as in claim 1, characterized in that the core's extremity has a frusto-conical cavity in which the valve member can be accurately positioned while in the open position and that will increase the effective magnetic force on the valve member by increasing the area through which magnetic flux can pass from the core to the valve member.

6. A fuel injector as in claim 1, characterized in that magnetic field flux will return to the body of said injector through the valve member seat.

7. A fuel injector as in claim 1, characterized in that the fuel injection section comprises at least one cylindrical orifice, parallel or inclined in respect of the injector's axis.

8. A fuel injector as in claim 1, characterized in that the fuel injection section comprises at least one orifice having a non-cylindrical shape.

9. A fuel injector as in claim 1, further comprising an unidirectional valve placed at the side opposite to the side containing the valve seat and the valve member, said unidirectional valve being kept open by the flow of fuel during normal operation of the fuel injector and closing as said flow ceases, whereby fuel leakage is prevented.

10. A fuel injector as in claim 1, characterized in that an elastic element is placed between the magnetic core and the valve member.

11. A 2 or 4 stroke internal combustion engine fitted with a fuel injection system using one or more fuel injectors as in claim 1.

12. A fuel injector as in claim 10, wherein magnetic particles are dispersed throughout the elastic element.

13. A fuel injection system for a 2 or 4 stroke internal combustion engine, comprising a plurality of fuel injectors wherein each fuel injector includes a guideless magnetic valve member with three dimensions of the same magnitude, a valve member seat, on which the valve member is seatable, a magnetic core disposed opposed to the valve member seat, a solenoid which is annularly shaped and defines a cavity where the core is positioned, the core being excitable by the solenoid in order to attract the valve member and generate a clearance between the seat and the valve member, which allows the flow of fuel, and a fuel injection section, through which the fuel which has passed said clearance is injected out of the injector, said valve seat extending in the direction of the core to constitute a duct and the clearance between the valve member and the seat having a first portion of decreasing section and a second portion of increasing section, characterized in that the valve member seat is made of magnetic material and is positioned at least partially within said cavity defined by the solenoid, whereby the valve member is always at least partially within said cavity, both when attracted or not attracted by the core.

* * * * *